United States Patent [19]

Watson

[11] Patent Number: 4,471,993

[45] Date of Patent: Sep. 18, 1984

[54] PERSONALIZED LOW BACK SUPPORT DEVICE

[76] Inventor: Steven R. Watson, 13841 Eton Pl., Santa Ana, Calif. 92705

[21] Appl. No.: 321,236

[22] Filed: Nov. 13, 1981

[51] Int. Cl.[3] ..... A47C 7/02

[52] U.S. Cl. ..... 297/230; 5/432; 297/284; 297/460

[58] Field of Search ..... 297/230, 284, 219, 460, 297/231; 5/457, 458, 432; 128/399

[56] References Cited

U.S. PATENT DOCUMENTS

| | | | |
|---|---|---|---|
| 1,667,626 | 4/1928 | Epstein | 5/432 |
| 1,982,516 | 11/1934 | Holmstead | 297/219 |
| 2,291,266 | 7/1942 | Wade | 5/432 |
| 2,894,565 | 7/1959 | Conner | 297/284 |
| 2,905,230 | 9/1959 | Gabriel | 297/284 X |
| 3,103,219 | 9/1963 | Chadner | 128/399 |
| 3,181,530 | 5/1965 | Storey | 297/465 X |
| 3,361,471 | 1/1968 | Radford | 297/230 |
| 3,464,754 | 9/1969 | Gottfried et al. | 297/284 |
| 3,608,106 | 9/1971 | Parramon | 5/DIG. 2 |
| 3,974,827 | 8/1976 | Bodeen | 297/284 X |
| 4,143,909 | 3/1979 | McFarlin | 297/219 X |
| 4,335,725 | 6/1982 | Geldmacher | 5/432 |

*Primary Examiner*—James T. McCall

*Attorney, Agent, or Firm*—Gordon K. Anderson

[57] ABSTRACT

A device with a semi-rigid structural support orthopedically contoured in concavo-convex shape formed on a mold the exact outline of the lumbar area of ones back. The support is covered with resilient material front and back and in the convex area. A fabric cover encloses the device and includes a zipper for convenience of closure. Reversible straps fastened to the cover provide attachment to chairs or seats to assure alignment with the back and maintain integrity of the device.

6 Claims, 11 Drawing Figures

30

PERSONALIZED LOW BACK SUPPORT DEVICE

BACKGROUND OF THE INVENTION

1. Field of the Invention

This invention relates to chairs and seats with supplemental lower primary backs and means to alter the contour, in general, more specifically individually molded, contoured low back support orthopedic cushions.

2. Description of Prior Art

Previously, auxillary lower back supports have been limited to flat, rigid structural members covered with resilient material or springs with the shape formed by the material itself, such as taught by Epstein in U.S. Pat. No. 1,667,626, Shapiro U.S. Pat. No. 2,769,485 and Arno U.S. Pat. No. 3,087,172. The outside shape of the above disclosures were fixed by the form of the filler with the integrity of configurations supplied by the rigid back. Other prior art utilizes a contoured form of pliable material only with no structure, as disclosed in U.S. Pat. No. 1,673,433 Wheeler et al, No. 3,765,721 Watkin, and No. 3,953,073 Esquivel. Further, U.S. Pat. No. 3,321,241 issued to Froelich indicates an orthopedic seat support having a flexible core with a rigid and contoured orthopedic device disposed in a pocket. While this invention has a contoured device, it is limited to being both rigid and shaped to the back of the average user. For background purposes and as indicative of the art to which the invention relates, reference may be made to U.S. Pat. No. 3,610,685 issued to Lay.

SUMMARY OF THE INVENTION

Previously cushions or low back supports are formed either with a rigid member located on the extreme back and covered with resilient material or made entirely of the same substance. The problem that exists is that the cushion is made to fit only the average user and has no allowance for a persons height, broadness of the lumbar area or shape of the lordotic curve. An orthopedic device, in order to be comfortable and supply the needed support, must conform in every detail to the users back or unnecessary pressure is exerted by the resilient material in some areas and significant force is lacking in others. Many attempts have been made to accomplish this personalized low back support as pressure on the spinal disks is optimized when sitting with the spine essentially straight. It is well known that the greatest pressure is exerted in the anterior sitting posture followed by the anterior straight and posterior sitting attitude, all of which are far greater than sitting with the back straight.

The need for an auxillary device that conforms exactly to the contour, form and configuration of the lumbar area of the back has long been needed, as chairs and seats of all kinds may not be conductive by themselves to purvey the optimum support in that area.

With the forgoing in mind, it becomes the primary object of the invention to provide such a device that fits exactly the subject area by the use of a pliable semi-rigid orthopedic shaped structural support member formed around a mold made directly from a persons back. The support, thus formed, not only fits exactly, but has additional resilient material, where in direct contact with the user, thus providing further comfort. A removable cover is also included for convenience with integral straps that provide attachment to a chair or seat.

An important object allows the device to be adapted to almost any conventional seating arrangement, such as an office or household chair, vehicle seat, sofa or lounge, mass media seating, etc. The inner structural support is semi-rigid with characteristics being firm enough to maintain its own structural integrity and yet elastic enough to conform to the characteristics of the seat when juxtapositioned thereon. Further, a strapping arrangement on the device allows fastening to prevent slipping and provide semi-permanent attachment to the chair or seat.

Another object of the disclosure provides proper and paragon support for the spine, thus eliminating lumbar spine distortion. As well as maintaining the normal lordotic curve, vertical spinal alignment is achieved as the normal lateral contour of the back horizontally includes convex sides which add support and are self-centering in the cavity.

Still another object allows the device to be easily fit and assembled by medical personnel or those trained in the field, using easily understood simple processes and a minimum of ancillary equipment. The temperatures involved in the forming processes are limited to heated water of a temperature normally found in a household or commercial tap and the cooling capabilities of a conventional refrigerator or freezer.

Yet another object is the simplicity of construction, as all components are precut and semi-assembled during manufacture, and practitioners in the medical field need only to form the mold and accomplish the final assembly procedures.

A further object provides open celled resilient material next to the user to keep the back cool, and with another embodiment the structural member contains a plurality of holes to increase the breathing capabilities with a passageway for air.

These and other objects and advantages of the present invention will become apparent from the subsequent detailed description of the preferred embodiment and the appended claims taken in conjunction with the accompanying drawings.

DESCRIPTION OF THE PREFERRED EMBODIMENT

Figure 1:
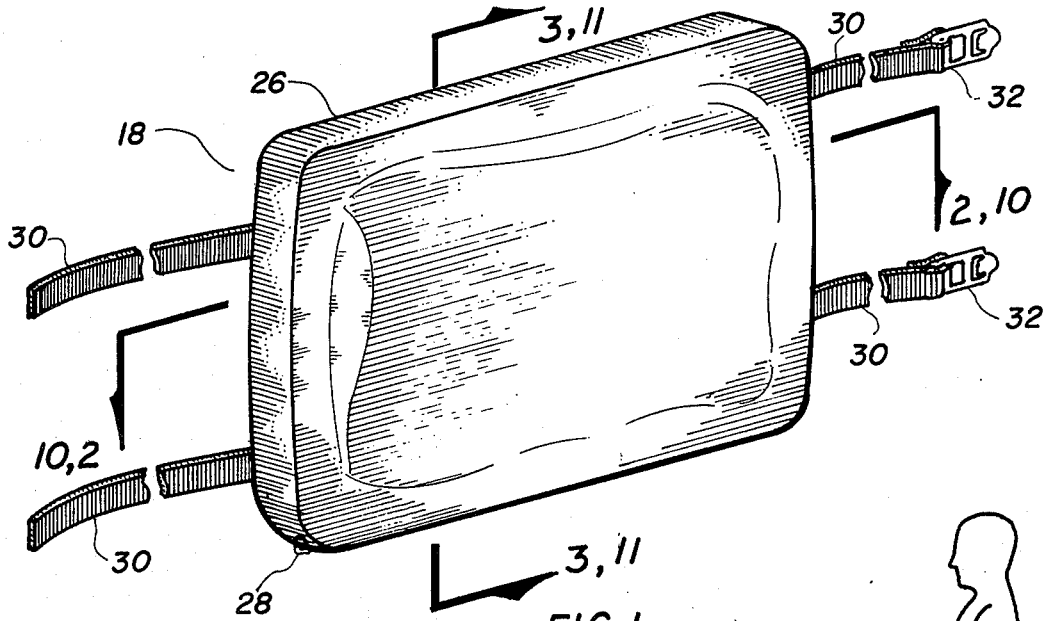
FIG. 1 is a partial isometric view of the preferred embodiment.
Figure 2:
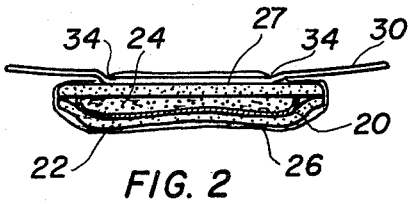
FIG. 2 is a partial sectional view taken along lines 2—2 of FIG. 1.
Figure 3:
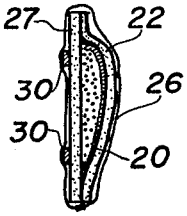
FIG. 3 is a partial sectional view taken along lines 3—3 of FIG. 1.
Figure 4:
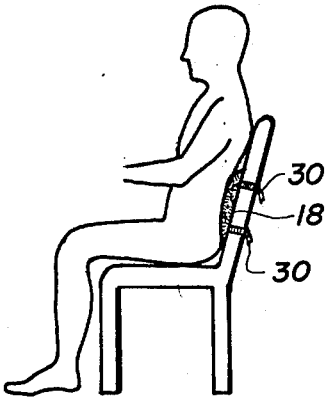
FIG. 4 is an outline of a person using the invention while it is attached to a chair illustrating the position of the device in relation to the users lumbar area.
Figure 5:
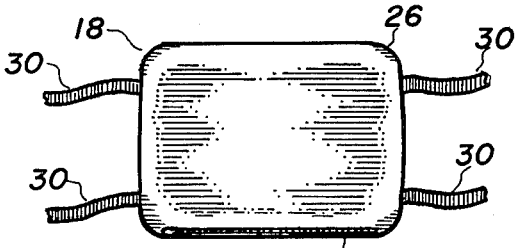
FIG. 5 is a partial elevation view of the invention viewed from the front.
Figure 11:
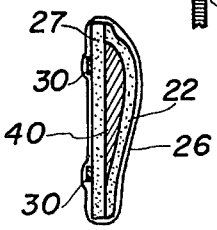
FIG. 11 is a partial sectional view of another embodiment taken along lines 11—11 of FIG. 1.

Referring now more particularly to the referenced characters of the drawing, the invention in the preferred embodiment 18 utilizes an orthopedic shaped structural support 20 made of a thermoplastic material that has the characteristics of strength and cohesive properties at normal ambient temperatures and becomes malleable at an elevated temperature above 160 degrees F. (72 degrees C. ). The structural support 20 is formed by placing a small mass of putty (not shown), with a film of thin clear polyethylene on two sides under the lumbar area of the back while lying horizontally on a hard surface. The putty is made of a type of silicone, such as commonly used by therapists for exercize, sometimes known under the registered trademark as "Theraplast". As the putty is pliable at room temperatures, the weight of the body and warmth of the skin cause the putty of flow into a pattern, filling completely the concavo-convex surface of the back. The material is then manipulated at the exposed edge forming a contoured shape at the curve of the persons side. The putty is then placed in a refrigerator or freezer and the temperature reduced to below room level. It has been experienced that the temperature need be only a minimal deviation, as the plasticity is sufficiently slowed at only a few degrees below the prevailing ambient temperature. Thermoplastic material in rectangular shape 20 is then heated to 160 degrees–170 degrees F. (72 degrees–77 degrees C.) in either a conventional oven, hydrocolator, or with a heat-gun, however, hot water is preferred. The material 20 is then placed upon the pre-cooled mold and gently hand formed to correspond to the shape and form of the mold. This shape then duplicates exactly the form of the subjects back and becomes an individualized and personalized support. The material, so formed, is then trimmed around the edges to remove any irregular shape and the corners are radiused completing the orthopedic shaped structural support 20. In another embodiment, the support 20 is formed in the same manner but is constructed with material having a plurality of holes in spaced relationship in a geometrical aray providing an air passageway allowing breathing of air from the front to the back of the device. The orthopedic shaped structural member 20 is covered with a front resilient member 22 as depicted in FIGS. 2, 3 and 11 with the orientation of the front, as illustrated in FIG. 4. This front member 22 is preferably open cell sponge with a polyethylene coating on the exposed side but may be of any suitable material, such as closed or open cell urethane, or the like. The front member 22 is of a consistant thickness and may be either entirely bonded by adhesive to the structural support 20 or only on the periphery. The purpose of the front member 22 is to add comfort to the device by its resiliency allowing irregular shapes, such as belts or clothing to be accommodated.

Figure 6:
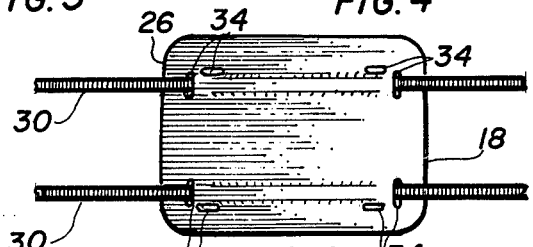
FIG. 6 is a partial rear elevation view with the attachment straps in the horizontal position.
Figure 7:
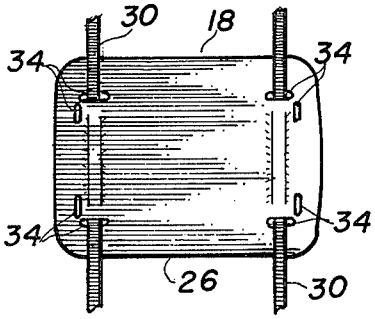
FIG. 7 is a partial rear elevation view with the attachment straps in the vertical position.
Figure 9:
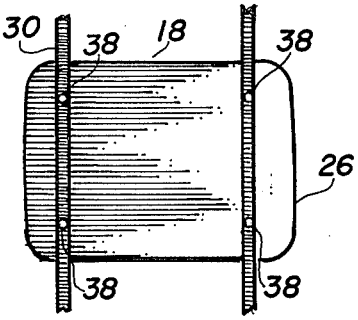
FIG. 9 is a partial rear view with the straps attached with snap fasteners in the vertical position.

On the side opposite the front member 22, the structural support 20 has juxtapositioned an inner core comprising an inner core spacer 24 and a back resilient member 27 adhesively bonded together. The inner core spacer 24 has a shape somewhat similar to the back of the support 20 and fills the irregular voids made by the orthopedic shape. The back resilient member 27 is flat and being bonded to the spacer 24 creates a pliable back being elastic enough to conform to the characteristics of a chair or seat and add body to the device. The material in both the core spacer 24 and back member 27 are of the same composition as the front member 22. The composite inner core, as well as the top member 22, may be adhesively bonded to the structural support 20 or the two outer resilient members may be bonded on the periphery, less one side, creating a pocket in which the structural support may be inserted with either configuration working equally well. A fabric enclosure 26 is added on the outside of the above assembly providing a protective cover that is removable for washing and is attractive, adding an asthetic feature to the invention. This enclosure 26 is of cloth material sewn around the edges with a slide fastener 28, known by its registered trademark zipper on one edge for access. Any other factening device would also be suitable, such as buttons, snaps, grippers, etc. On the backside of the cover are points of attachment for a strapping arrangement. In one embodiment slots 34 are provided, at least a pair, oriented vertically and located near the edge for two straps 30. A similar set are horizontally positioned, as shown in FIGS. 6 and 7. This arrangement allows the straps 30 to be located in any combination vertically or horizontally for ease of attachment to the chair or seat. In another embodiment snaps 38 are provided for attachment, as depicted in FIG. 9 utilizing snaps or grippers 38 in both the cover 26 and straps 30. The location of the snaps 38 is equidistant in each centerline location allowing vertical or horizontal attachment of the straps 30.

Figure 8:
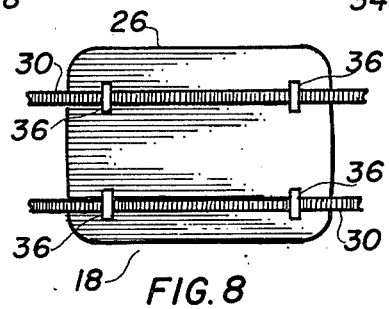
FIG. 8 is a partial rear view with the straps attached through loops horizontally.

Another alternate embodiment, depicted in FIG. 8 incorporates the use of fabric loops 36 attached directly to the enclosure 26 by sewing. These loops are utilized in the same manner as above. The straps 30 are of any suitable material, such as leather or vinyl, with nylon being preferred. The width and thickness may vary, only flexability and strength need be considered. On one end a buckle 32 is attached allowing the strap to be attached to itself and tightened. The straps encircle the seating arrangement in looping relationship to hold the device in place while in use.

Figure 10:
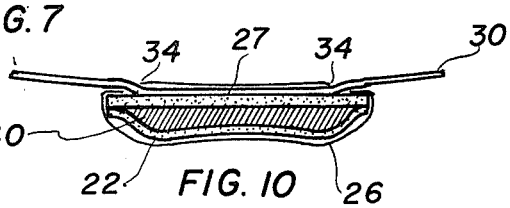
FIG. 10 is a partial sectional view of another embodiment taken along lines 10—10 of FIG. 1.

Another embodiment of the invention, shown in FIGS. 10 and 11, functions and is attached in the manner as the above embodiment, however, the structure is formed differently. In place of the structural support member 20 and the interior core spacer 24 is a molded semi-rigid structure 40 of polyurethane foam. This material by itself has sufficient structural integrity to maintain the desired configuration and when supported by laminating the resilient front member 22 and the back resilient member 27 the characteristics of strength and ductility are further enhanced. The structure 40 is molded to the body directly by mixing the resin and catalyst together and placing the composite into a confined area surrounding the small of ones back while lying horizontally. An open sided mold of disposable material, such as cardboard or a polyethylene sheet lined permanent mold may be used for the confined area. A thermal insulation, such as a fabric blanket is used between the foam and the back, as heat is produced in the foaming process. The foam expands into the mold and fills the entire space completely conforming to the concavo-convex surface of the lumbar area in somewhat of a wedge shape. The surplus material is vented to the sides and when the expansion is completed the material is removed from the mold, or in the case of the cardboard, may remain intact and is then trimmed around the edges making a uniform rectangular shape. The resilient front member 22 and back member 27 is attached in the same manner as in the previous embodiment and the remainder of the invention is the same.

While the invention has been described in complete detail and pictorialy shown in the accompanying drawings it is not to be limited to such details, since many changes and modifications may be in the invention without departing from the spirit and the scope thereof. Hence, it is described to cover any and all modifications and forms which may come within the language and scope of the appended claims.

I claim:

1. A device for supporting the low back area of the body comprising:

(a) an orthopedic shaped structural support having a top and bottom comprised of a semi-rigid substance having the exact configuration of ones lower back for supporting the lumbar area by contiguous structural intervention.

(b) a front resilient member juxtaposed on the front of said structural support providing an elastic, springy surface for engaging ones lumbar back area.

(c) an inner core contiguous with the back of said structural support complementary thereto and filling voids made by said orthopedic shape, (d) a fabric enclosure encompassing said structural support front resilient member and inner core having means for closing and means for strap fastening thereto providing a removable protective cover with integral strap attaching points, and (e) a plurality of straps connected to said strap fastening means providing a method of attachment to a seating structure to maintain said device in proper orientation with the lumbar area of ones back by intimately embracing the seating structure contiguous therewith.

2. The inner core according to claim 1 further comprising:

(a) an interior core spacer of resilient material having a form somewhat similar to and juxtaposed with said structural support for filling irregular voids made by said orthopedic shape, (b) a back resilient member attached to said interior core creating a pliable back to said device being elastic to conform to the characteristics of a seating structure when fastened thereon.

3. The means for closing according to claim 1 comprising:

a slide fastener on one side.

4. The strap fastening means recited in claim 1 comprising:

said fabric enclosure having a plurality of slots on one surface in spaced relationship allowing said straps to be inserted therein in combination to the configuration of the seating arrangement.

5. The strap fastening means recited in claim 1 comprising:

a plurality of snaps attached to one surface of said fabric enclosure in spaced relationship allowing said straps to be attached thereto in combination to the configuration of the seating arrangement.

6. The straps according to claim 1 further comprising:

a buckle on the first end attached in looping relationship, providing fastening to the second end with tightening adjustments to encircle the seating arrangement when fastening said device.

* * * * *